United States Patent [19]

Holden

[11] 4,047,141

[45] Sept. 6, 1977

[54] CALIBRATION AND MOUNTING STRUCTURE FOR MOTOR CONTROLLERS OR THE LIKE

[75] Inventor: Ronald L. Holden, Mansfield, Ohio

[73] Assignee: Therm-O-Disc, Inc., Mansfield, Ohio

[21] Appl. No.: 653,538

[22] Filed: Jan. 29, 1976

[51] Int. Cl.[2] ..... H01H 61/00

[52] U.S. Cl. ..... 337/89; 337/94

[58] Field of Search ..... 337/89, 94, 343, 347, 337/365, 368

[56] References Cited

U.S. PATENT DOCUMENTS

| | | | |
|---|---|---|---|
| 2,488,049 | 11/1949 | Bolesky | 337/365 |
| 2,839,640 | 6/1958 | Epstein | 337/89 X |
| 2,892,910 | 6/1959 | Diebold | 337/89 |
| 3,103,566 | 9/1963 | Epstein | 337/89 |

*Primary Examiner*—George Harris

*Attorney, Agent, or Firm*—McNenny, Pearne, Gordon, Gail, Dickinson & Schiller

[57] ABSTRACT

A motor overload protector or the like is disclosed in which a bimetal snap disc is centrally supported by a stud which is press fitted into a bore within the body. The stud is knurled to provide axially extending teeth having a root diameter at least substantially equal to the diameter of the body stud receiving bore prior to the insertion of the stud so that sufficient friction is provided to maintain the stud in the calibrated position. Additional locking is provided where necessary by forming the stud with annular ribs which interlock with a potting material applied after assembly of the stud within the body. The device is calibrated by maintaining the disc at the desired operating temperature as the stud is pressed into the body stud receiving bore until the disc operates.

6 Claims, 3 Drawing Figures

CALIBRATION AND MOUNTING STRUCTURE FOR MOTOR CONTROLLERS OR THE LIKE

BACKGROUND OF THE INVENTION

This invention relates generally to control devices such as motor overload protectors or the like, and more particularly to a device of such type employing novel and improved means for mounting and calibrating a bimetal snap element.

PRIOR ART

Control devices utilizing bimetal snap elements are well known. Such snap elements are usually formed with a shallow, dished shape, which causes such element in its free state to snap back and forth between two positions of stability upon reaching predetermined snap temperatures. In some controls, the snap element is provided with one or more contacts mounted thereon which snap into and out of engagement with associated fixed contacts to perform a switching function. In such devices, the control current flows through the snap element and a device is, therefore, current sensitive. Such controls are often used as motor overload protectors. Examples of such a control are illustrated in the U. S. Pat. Nos. 2,080,556; 2,434,984; 2,866,039; 2,967,920; 3,013,138 and 3,753,195.

In such motor overload protectors, it is often the practice to form the snap elements so that the desired calibration or operating temperature of the device is between the free state of snap temperatures thereof. The snap element is calibrated during assembly by mounting the snap element on a threaded mounting element or stud, which is threaded into a threaded bore in the housing. The control is calibrated during assembly by maintaining the snap element at the desired operating temperature while the threaded mounting stud is threaded in to deform the snap element from one free position of stability toward the other free position of stability until the element is pulled in enough to cause it to operate at the desired calibration temperature. In such devices, it is necessary to construct the mounting structure so that it is maintained, after assembly, in its calibration position. One such structure employs a lock nut which is threaded onto the stud exteriorly of the body. In practice, the lock nut is tightened prior to calibration to load the thread structure and the nut is held against rotation as the stud is threaded in during calibration. The lock nut is not moved after calibration, since the tightening of the nut would tend to alter the calibration of the device. With such a structure, it is necessary to accurately tighten the lock nut so that it provides the necessary loading of the thread structure, allows calibration rotation of the stud, and thereafter locks the stud in the calibration position.

Generally, the bodies of such controls are formed of molded parts made of a phenolic resin material or the like. When threaded mounting means are required, it is necessary to thread the mounting stud and also form threads in the body. Such threads must be accurately produced and require separate threading operations. When a lock nut is used, an additional part must be manufactured and assembled. Further, the tightening of the lock nut must be carefully controlled.

SUMMARY OF THE INVENTION

In accordance with the present invention, a novel and improved mounting and calibration structure is provided for a bimetal snap element which is economical to produce and easy to assemble. With such structure, it is not necessary to form threads on either the mounting stud or the body part. During assembly, the stud is pressed with an interference fit into an unthreaded bore formed in the body while the snap element is maintained at the desired calibration temperature until the snap element operates. The structure of the mounting stud and the body is arranged so that sufficient friction is established to maintain the stud in the calibrated position after assembly.

In the illustrated embodiment, a motor overload protector is shown with a mounting stud knurled to provide axially extending teeth which bite or cut into the material of the bore along the surface of the bore as the stud is pressed into the calibrated position. In addition, the body is formed with a counter-bore extending in from the exterior side which is filled with the potting material after calibration. The illustrated stud is formed with annular grooves and ridges which provide good mechanical locking with the potting material. In this embodiment a simple, low-cost mounting structure is provided which can be easily assembled and calibrated to reduce the manufacturing costs of the device when compared to comparable prior art devices.

DETAILED DESCRIPTION OF THE DRAWINGS

Figure 1:
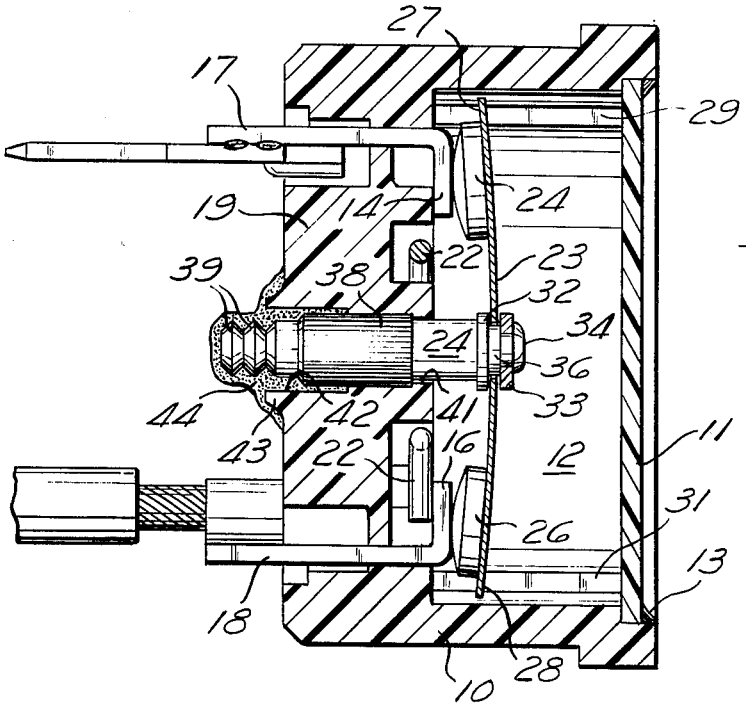
FIG. 1 is a side elevation generally in longitudinal section illustrating a motor overload protector incorporating the present invention.

The illustrated embodiment of this invention is a motor overload protector including a housing assembly comprising a cup shaped body member 10 and a cover member 11, cooperating to define a generally cylindrical switch chamber 12. Preferably, the body 10 and cover 11 are molded of a phenolic resin or the like and the cover is secured in position by an adhesive at 13. In the illustrated embodiment, a pair of fixed contacts 14 and 16 are provided by lateral portions formed on terminals 17 and 18. The terminals extend through openings in the base wall 19 of the body to the exterior of the device so that the device can be connected to an external circuit. A third terminal member 21 is provided which is connected to one end of a resistance heater 22 that extends with a serpentine path and is connected at its other end to the rearward side of the fixed contact 16.

Figure 2:
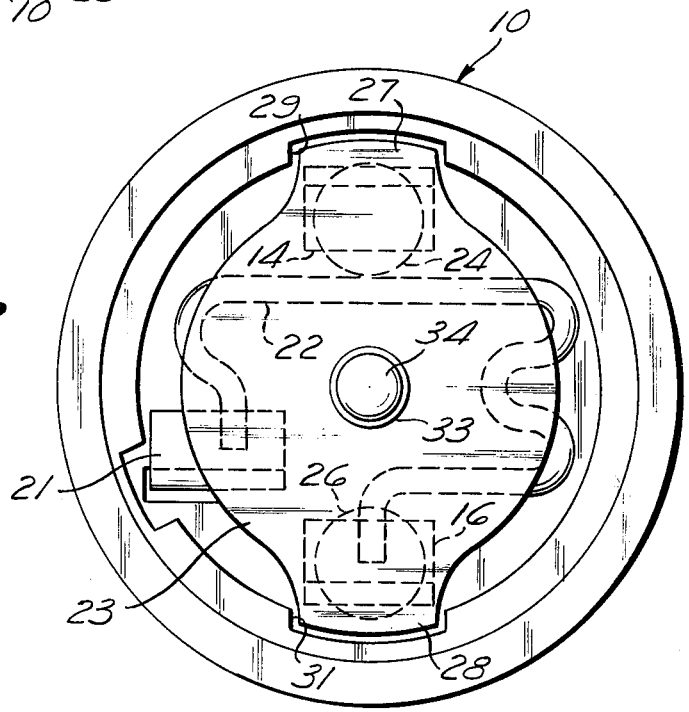
FIG. 2 is an end view of the device illustrated in FIG. 1 with the end cover removed for purposes of illustration; and, FIG. 3 is a side elevation of the mounting stud before assembly thereof with the bimetal snap element.
Figure 3:
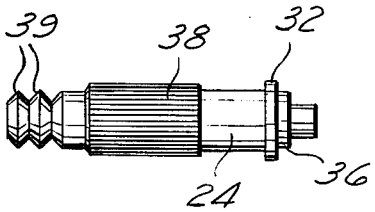

A shallow dished shaped bimetal snap element 23 is mounted on a mounting stud 24 at its center and is provided with a pair of peripherally located movable contact elements 24 and 26, which snap into and out of engagement with the fixed contacts 14 and 16, respectively, when the snap element 23 snaps back and forth in response to changes in the temperature thereof. The snap element is generally circular in shape, as best illustrated in FIG. 2, but is provided with opposed projections 27 and 28, which project into mating recesses 29 and 31, formed in the body 10 to prevent rotation of the snap element about its central axis and to insure that the contacts are properly aligned.

The snap element 23 is loosely held between a shoulder 32 formed on the mounting stud, and a washer 33 which is secured on the stud by upsetting the end at 34 (as illustrated in FIG. 1). The stud is formed with a step 36 having an axial height slightly greater than the thickness of the bimetal snap element to space the washer 33 from the shoulder 32 and insure that the snap disc is not tightly gripped. Such structure prevents the mounting of the snap element on the stud from significantly altering the operating characteristics of the snap element.

The stud 24 is provided with an enlarged knurled portion 38, spaced from the shoulder 32 and a plurality of annular ribs and grooves 39 adjacent to the end of the mounting stud opposite the shoulder 32. The body base wall 19 is formed with a central bore 41 extending from the switch cavity 12 to a counter-bore 42, which in turn extends the remainder of the distance through the base wall 19. A boss 43 is formed in the base wall 19 around the counter-bore 42.

The bore 41 is sized to provide an interference fit with the knurled portion 38 of the stud so that as the stud is pushed into the bore, the teeth of the knurled portion bite into the phenolic material and produces an interference engagement with substantial friction. The counterbore 42 is sized to receive the knurled portion with slight clearance. Preferably, the amount of interference between the knurled portion and the bore 41 is in the order of 0.011 inches and the depth of the teeth of the knurl is in the order of 0.005 inches so that the diameter of the bore 41 initially formed in the base wall is substantially equal to the root diameter of the knurled portion.

The various elements are also proportioned so that at least one annular groove 39 is located adjacent to or within the counter-bore 42. The ribs and grooves provide radially and peripherally extending surfaces which mechanically interlock with a potting material 44. The potting material such as epoxy is applied to the end of the mounting stud 24 after it is installed in the body to augment the frictional locking of the mounting stud in its mounted calibrated position. Such potting material 44 flows inwardly along the annular ribs and into the counter-bore 42, around the stud to insure that the stud is locked against movement even after the device has been thermally cycled. The thermal cycling of the control tends to cause a relaxation of the pressure of engagement between the body material and the stud when the temperatures encountered are relatively severe and potting material 44 is used on controls which must operate under severe temperature conditions to prevent such relaxation of the interference pressure from allowing the stud to become sufficiently loose to lose its calibration. In instances where the operating conditions are not particularly severe, the potting material 44 may not be required and the locking of the stud in position can be provided solely by the interference between the stud and the body material.

The assembly and calibration of the device is easily accomplished. First, the various terminals and the heater are installed within the body and the snap element 23 is mounted on the mounting stud as a subassembly. The mounting stud is then pressed into the bore 41 while the snap element 23 is maintained at the desired operating or calibration temperature of the snap element. The mounting stud is pressed inward until the contacts 24 and 26 engage their respective contacts 14 and 16 to limit further inward movement of the adjacent peripheral portions of the snap element. As the stud is pressed further into the bore 41, after engagement between the contacts, the snap element 23 is deformed from its free state inwardly curved position of stability toward its outwardly curved free state position of stability. When the pressing of the stud 24 progresses an amount necessary to pull the snap element in so that it operates at the calibration temperature of the snap element, the snap element snaps through to its outwardly curved position of stability opening the contacts. The snap action of the snap element is sensed to terminate further movement of the stud and the calibration of the device is completed. A power actuator is preferably used to press the stud 24 into its calibrated position. One such general actuating arrangement is illustrated in the U.S. Pat. No. 3,636,322, granted on Jan. 25, 1972 to Schmitt and the disclosure of such patent is incorporated herein by reference.

Because the stud is frictionally locked in position, it is not necessary to provide a lock nut or the like to retain the stud in its calibrated position. However, in instances where additional locking of the stud in its calibrated position is desired, a potting material 44 is applied to the end of the stud to provide means for locking the stud in its calibrated position.

It should be recognized that with the illustrated embodiment in which knurled teeth bite into the material forming the body, a very high frictional contact is provided and a good interlocking is produced. Any particles of base material which are actually shaved or cut out by the movement of the knurled portion into the bore, do not present any problems, since they cannot migrate back to the switch cavity 12 and either remain in the counter bore or fall clear of the device. After calibration, the assembly is completed by installing and sealing the cover member 11.

It should be understood that the assignee of the present invention has manufactured a similar device which constitutes prior art with respect to this invention. Such similar device differed from the illustrated embodiment of this invention in that threads were provided on the stud and in the stud receiving bore so that the stud was assembled in the body by threading the stud into the bore. In such prior art device, the locknut was threaded into the stud exteriorly of the body before calibration and was tightened to load the threads and to provide friction along the threads resisting rotation of the stud subsequent to calibration. Calibration was accomplished by rotating the stud against the friction produced by the lock nut while holding the lock nut against rotation until the snap element operated. Such calibration, of course, was performed while the snap element was maintained at calibration temperature. The lock nut was not turned after calibration, since any change in the tightness of the lock nut would tend to alter the calibration obtained. After calibration, a paint type material was applied over the end of the stud and the lock nut to resist turning of the lock nut. However, such paint type material did not contribute to any material extent to the axial locking of the stud within the body. Its purpose was merely to prevent vibration from causing rotation of either the lock nut or the stud.

With the present invention, the necessity of forming threads in the body is eliminated and the stud is assembled and the device is calibrated by the mere operation of pressing the stud into the bore to calibrate the snap element. Consequently, the cost of manufacturing parts is reduced and the cost of assembling and calibrating the device is also reduced.

Although a preferred embodiment of this invention is illustrated, it is to be understood that various modifications and rearrangements may be resorted to without departing from the scope of the invention disclosed and claimed.

What is claimed is:

1. A control device comprising a molded plastic body formed with a bore, a bimetal snap element providing in its free state first and second positions of stability and operable in response to first and second predetermined temperatures thereof to snap between said positions, a mounting stud supporting said snap element on said body, said stud providing axially extending knurling intermediate its ends providing axially extending teeth, said teeth having a maximum radius greater than the radius of said bore initially formed in said body, said teeth being positioned within said bore and biting into the material of said body around said bore to provide high frictional engagement resisting axial movement of said stud with respect to said body, said body providing a counter-bore extending from the exterior of said body to said bore having a diameter at least substantially as large as the maximum diameter of said teeth, said stud providing radially and peripherally extending surfaces, and potting material extending into said counter-bore around said stud mechanically interlocking with said radially and peripherally extending surfaces cooperating with said frictional engagement to resist movement of said stud with respect to said body.

2. A control device comprising a molded plastic body formed with a bore, a bimetal snap element providing in its free state first and second positions of stability and operable in response to first and second predetermined temperatures thereof to snap between said positions, a mounting stud supporting said snap element on said body, said stud providing axially extending knurling intermediate its ends providing axially extending teeth, said teeth having a maximum radius greater than the radius of said bore initially formed in said body, said teeth being positioned within said bore and biting into the material of said body around said bore, said stud being formed with radially and peripherally extending surfaces on the side of said knurling remote from said snap element, and a potting material interlocking with said radially and peripherally extending surfaces and with said body, said teeth providing a high frictional engagement with said body cooperating with said potting material to resist axial movement of said stud with respect to said body.

3. A control device as set forth in claim 1 wherein said counter-bore has a diameter not substantially greater than the maximum diameter of said teeth, and said radially and peripherally extending surfaces have a maximum diameter at least as small as the diameter of said teeth.

4. A control device as set forth in claim 1 wherein at least one of said radially and peripherally extending surfaces is located within said counter-bore.

5. A control device as set forth in claim 4 wherein said radially and peripherally extending surfaces are provided by annular ribs and grooves formed on said stud.

6. A control device as set forth in claim 1 wherein said stud is formed with axially extending knurls providing teeth having a root diameter at least as great as the diameter of said bore before insertion of said stud whereby said teeth bite into the material of said body around said stud.

* * * * *